US006926398B2

(12) United States Patent
Ando et al.

(10) Patent No.: US 6,926,398 B2
(45) Date of Patent: Aug. 9, 2005

(54) LIQUID-FEEDING DEVICE AND LIQUID EJECTION APPARATUS

(75) Inventors: Makoto Ando, Tokyo (JP); Takumi Namekawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 5 days.

(21) Appl. No.: 10/435,810

(22) Filed: May 12, 2003

(65) Prior Publication Data

US 2004/0017446 A1 Jan. 29, 2004

(30) Foreign Application Priority Data

May 13, 2002 (JP) ..... 2002-136489

(51) Int. Cl.[7] ..... B41J 2/175
(52) U.S. Cl. ..... 347/86; 222/481.5
(58) Field of Search ..... 347/85, 86, 87; 222/481.5, 482, 496, 544, 559

(56) References Cited

U.S. PATENT DOCUMENTS 5,796,419 A * 8/1998 Clark et al. ..... 347/85
5,801,737 A * 9/1998 Sato et al. ..... 347/86
5,821,965 A * 10/1998 Oda et al. ..... 347/86

* cited by examiner

*Primary Examiner*—Lamson Nguyen
*Assistant Examiner*—Blaise Mouttet
(74) *Attorney, Agent, or Firm*—Robert J. Depke; Trexler, Bushnell, Giangiorgi, Blackstone & Marr

(57) ABSTRACT

There is provided a liquid-feeding device with large liquid-capacity and a simplified structure and capable of stably holding liquid without leakage. An ink-feeding device includes an ink reservoir; an ink chamber; a valve displaced so that a closing member opens an open region by reduction in pressure due to reduction in the ink amount in the ink chamber; a fresh-air communicating hole for communicating with fresh air; and an air inlet tube capable of bringing air, when an amount of ink in the ink chamber is reduced, from the fresh-air communicating hole by the amount of air corresponding to the amount of the reduced ink, wherein a bore diameter of the lower end of the air inlet tube and a water head are determined so that the ink meniscus holding power P at the lower end of the air inlet tube and the water head pressure H corresponding to the height from the bottom surface of an ink ejection unit (nozzle surface) to the lower end of the air inlet tube satisfy the relationship P>H.

8 Claims, 10 Drawing Sheets

| | | | | | | | | | | | |
|---|---|---|---|---|---|---|---|---|---|---|---|
| INK SURFACE TENSION | $\gamma$ | [N/m] | 0.03 | 0.03 | 0.03 | 0.03 | 0.03 | 0.03 | 0.03 | 0.03 | 0.03 |
| HOLE DIAMETER | D | [mm] | 0.1 | 0.2 | 0.3 | 0.4 | 0.5 | 0.61 | 0.8 | 1 | 2 |
| PERIPHERAL LENGTH | L | [mm] | 0.31 | 0.63 | 0.94 | 1.26 | 1.57 | 1.92 | 2.51 | 3.14 | 6.28 |
| TENSION | | [N] | 9.42E-06 | 1.88E-05 | 2.83E-05 | 3.77E-05 | 4.71E-05 | 5.75E-05 | 7.54E-05 | 9.42E-05 | 0.000188 |
| HOLE OPENING SPACE | S | [mm²] | 0.00785 | 0.03142 | 0.0707 | 0.126 | 0.1963 | 0.292 | 0.503 | 0.79 | 3.14 |
| CONTACT ANGLE | $\theta$ | [°] | 5 | 5 | 5 | 5 | 5 | 5 | 5 | 5 | 5 |
| | | [radian] | 0.087 | 0.087 | 0.087 | 0.087 | 0.087 | 0.087 | 0.087 | 0.087 | 0.087 |
| MENISCUS HOLDING POWER | P | [N/mm²] | 0.001195 | 0.000598 | 0.000398 | 0.000299 | 0.000239 | 0.000196 | 0.000149 | 0.00012 | 5.98E-05 |
| | | [N/m²] | 1195 | 598 | 398 | 299 | 239 | 196 | 149 | 120 | 60 |
| | | [Pa] | 1195 | 598 | 398 | 299 | 239 | 196 | 149 | 120 | 60 |
| | | [atm] | 0.0118 | 0.0059 | 0.00393 | 0.00295 | 0.00236 | 0.00193 | 0.00147 | 0.00118 | 0.00059 |
| | | [mmAq] | 121.9 | 61.0 | 40.6 | 30.5 | 24.4 | 20.0 | 15.2 | 12.19 | 6.10 |

LIQUID-FEEDING DEVICE AND LIQUID EJECTION APPARATUS

This application claims priority to Japanese Patent Application Number JP2002-136489 filed May 13, 2002 which is incorporated herein by reference.

BACKGROUND OF THE INVENTION

1. Field of the Invention

The present invention relates to a liquid-feeding device for feeding liquid to an external device such as a liquid ejection unit and a liquid ejection apparatus incorporating the liquid feeding device, such as an inkjet printer head, and more specifically it relates to a technique for stably holding a large amount of liquid without liquid leakage and with a simplified low-cost structure.

2.Description of the Related Art

As an ink-feeding device for use in a conventional printer head, the following device has been known, for example.

FIG. 13 is a sectional view of an internal structure of a first example of a conventional ink-feeding device of the type. Referring to FIG. 13, an ink reservoir 201 partitioned into an ink tank 201*a* and an ink container 201*b*. The ink tank 201*a* and the ink container 201*b* are communicated with each other on the bottom surface.

In the ink tank 201*a*, ink is contained. On the top of the ink container 201*b*, a vent hole 202 is formed. Furthermore, within ink container 201*b*, a porous material 203 is provided for holding ink. Moreover, on the bottom of the ink container 201*b*, an ink outlet 204 is provided.

If ink is discharged from the ink outlet 204, air enters the ink tank 201*a* so that the amount of ink corresponding to that of the air is fed to the ink container 201*b* from the ink tank 201*a* so as to be held in the porous material 203.

Wherein owing to capillary force of the porous material 203, a force is applied to the ink in a direction absorbing the ink, so that the ink cannot leak from the ink outlet 204.

FIG. 14 is a sectional view of an internal structure of a second example of a conventional ink-feeding device. Referring to FIG. 14, in the same way as the first example, the ink outlet 204 is provided on the bottom of an ink reservoir 205. Also, within ink reservoir 205, a porous material 206 is provided for holding ink. To the porous material 206, a force is constantly applied in directions (arrow directions in FIG. 14) spreading out the porous material 206 with a spring 207. By the force of the spring 207, a force is applied to the ink within the porous material 206 in a direction in that ink is absorbed. Thereby, the ink cannot leak from the ink outlet 204 in the same way as the first example.

As described above, the ink-feeding device for use in a printer head is structured so that ink cannot leak from the ink outlet 204.

However, the conventional technique described above has the following problems.

In the first example, since the porous material 203 is provided within the ink container 201*b*, the capacity of the ink-feeding device is reduced by the volume of the porous material 203. Therefore, there has been a problem that the ink capacity within the device is small relative to the entire size of the ink-feeding device.

Also, since the second example is a system using the spring 207, there are problems in manufacturing that if the ink reservoir 205 is reduced in thickness, for example, the spring 207 cannot be accommodated within the bag 206, and the manufacturing process is complicated. Furthermore, this is a structure in that the spring 207 is accommodated inside the bag 206, so that there have been problems that the mechanism is complicated and the cost is also increased.

SUMMARY OF THE INVENTION

Accordingly, it is an object of the present invention to provide an ink-feeding device with large liquid-capacity and a simplified structure and capable of stably holding liquid without leakage.

In addition, in order to solve the problems described above, Japanese Patent Application No. 2001-322361, to the same assignee as in the present invention, has been already disclosed. The present invention has been made to further improve this application so that even if a valve does not normally function, the gas-liquid interchange can be performed by preventing liquid leakage.

The present invention solves the problems described above by the following solving means.

A liquid-feeding device according to the present invention comprises a liquid reservoir for containing liquid therein; a liquid chamber connected to the liquid reservoir so that liquid in the liquid reservoir can flow down; a valve comprising an open region between the liquid reservoir and the liquid chamber and a closing member urged so as to close the open region so that the closing member is displaced so as to open the open region by the reduction in pressure of the liquid chamber due to the reduction in the amount of liquid in the liquid chamber; a fresh-air communicating hole built in the liquid reservoir for communicating with fresh air; and an air inlet tube arranged to extend from the fresh-air communicating hole toward the inside of the liquid reservoir so that when an amount of liquid in the liquid chamber is reduced, the amount of air corresponding to the amount of the reduced liquid can be brought into the liquid reservoir from the fresh-air communicating hole, wherein a bore diameter of the lower end of the air inlet tube and a water head are determined so that the meniscus holding power P of liquid at the lower end of the air inlet tube and the water head pressure H corresponding to the height from a liquid outlet, to which the atmospheric pressure is applied, of an external device connected to one of the liquid reservoir and the liquid chamber to the lower end of the air inlet tube satisfy the relationship $P>H$.

According to the present invention described above, if liquid is fed from the liquid-feeding device to the outside, the pressure in the liquid chamber is reduced. Thereby, a sucking force for bringing liquid inside is produced in the liquid chamber, and the closing member is displaced by this sucking force so that the liquid reservoir is communicated with the liquid chamber so as to feed liquid from the liquid reservoir to the liquid chamber.

If liquid is fed from the liquid reservoir to the liquid chamber, the amount of liquid in the ink reservoir is reduced, so that an amount of air corresponding to the reduced liquid is brought into the liquid reservoir from the fresh-air communicating hole via the air inlet tube. When the pressure in the liquid chamber is returned to the normal state by feeding liquid from the liquid reservoir to the liquid chamber, the closing member closes between the liquid reservoir and the liquid chamber. Thereby, the liquid feeding from the liquid reservoir to the liquid chamber is stopped while the air intake from the fresh-air communicating hole into the liquid reservoir is stopped.

Also, the closing member of the valve is displaced so as to open the open region by the reduction in pressure of the liquid chamber; if the valve is supposed not to function normally, there may a problem that the closing member holds the open region open. In such a case, the pressure in the liquid-feeding device cannot be appropriately maintained (a pressure lower than the atmospheric pressure and capable of holding liquid from leaking), so that liquid may leak.

On the other hand, at the lower end of the air inlet tube, the liquid meniscus is formed. According to the present invention, the meniscus holding power P of liquid at the lower end and the water head pressure H corresponding to the height from a liquid outlet, to which the atmospheric pressure is applied, of an external device connected to the liquid reservoir or the liquid chamber to the lower end of the air inlet tube satisfy the relationship P>H.

Therefore, even when the closing member holds the open region open, since the liquid meniscus is held at the lower end of the air inlet tube, air cannot enter the liquid reservoir from the lower end of the air inlet tube. The pressure in the liquid-feeding device is thereby maintained appropriately, preventing liquid from leaking out.

DESCRIPTION OF THE PREFERRED EMBODIMENTS

Embodiments of the present invention will be described below with reference to the drawings. According to the following embodiments, an ink-feeding device and an inkjet printer head using the ink-feeding device are exemplified as a liquid-feeding device and a liquid ejection apparatus.

(First Embodiment)

Figure 1:
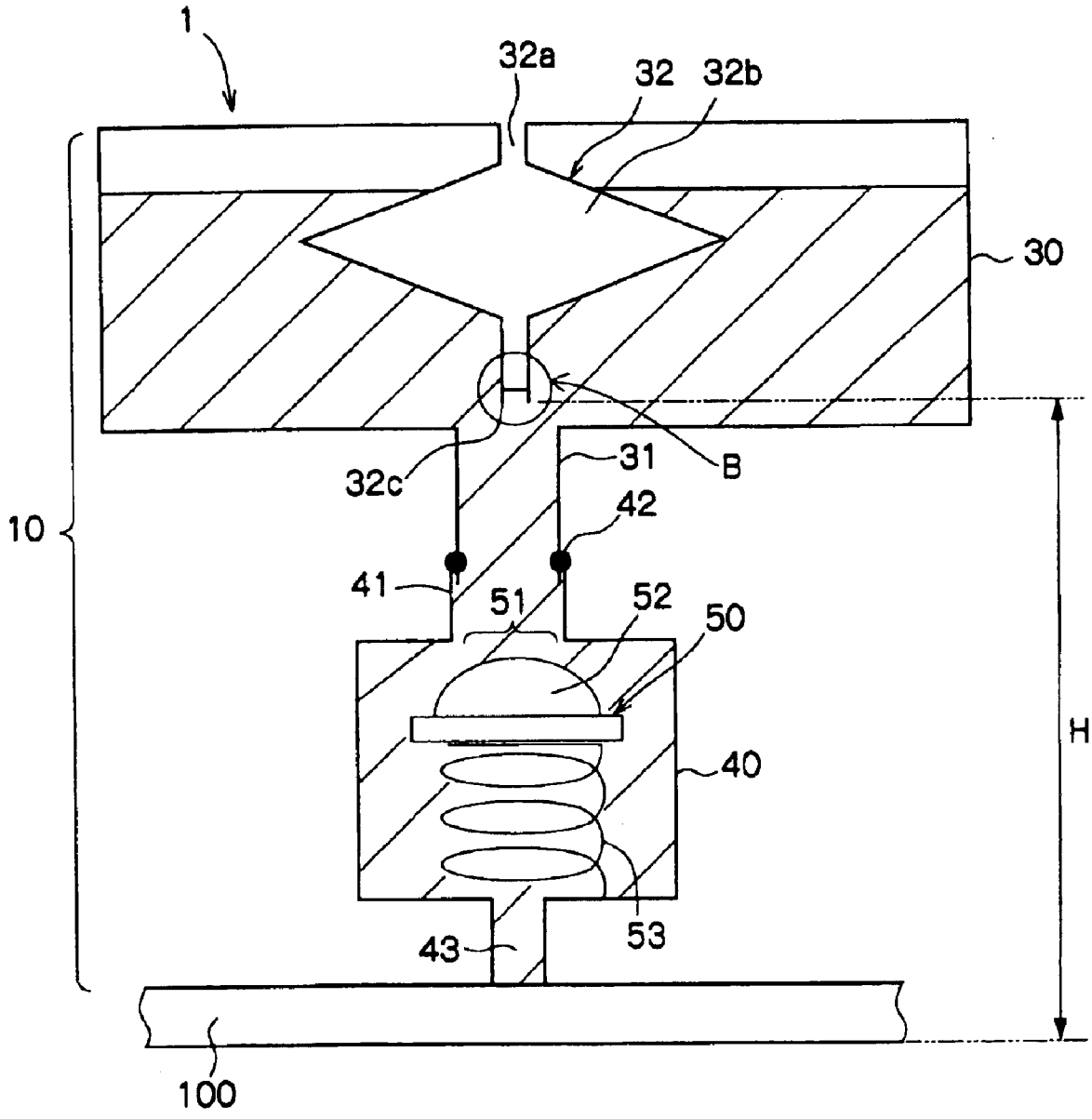
FIG. 1 is a front sectional view of a printer head according to a first embodiment of the present invention.

FIG. 1 is a front sectional view of an inkjet printer head (simply referred to below as a printer head) 1 according to a first embodiment of the present invention. The printer head 1 comprises an ink-feeding device 10 and an ink ejection unit 100. The ink ejection unit 100 corresponds to a liquid ejection unit according to the present invention and only a contour thereof is shown in FIG. 1.

The ink-feeding device 10 comprises an ink reservoir (ink tank) 30, an ink chamber 40, and a valve 50. Wherein the ink reservoir and the ink chamber correspond to a liquid reservoir and a liquid chamber according to the present invention, respectively.

In the ink reservoir 30 constructed to be container shaped, ink is charged. Referring to FIG. 1 and so forth, the ink within the ink reservoir 30 is indicated by oblique lines.

On the bottom surface of the ink reservoir 30, a cylindrical nozzle 31 is provided, which is connected to a connection part 41 integrally constructed with the top surface of the ink chamber 40.

Within the ink reservoir 30, an air inlet tube 32 is provided, which is opened on the surface of the ink reservoir 30 so as to form a fresh-air communicating hole 32*a*. The air inlet tube 32 is provided with a buffer section 32*b* arranged in the vicinity of the center thereof and having a diameter larger than the aperture diameter of the fresh-air communicating hole 32*a* and the lower end 32*c* of the air inlet tube 32 so as to be communicated with the air inlet tube 32. According to the embodiment, as shown in FIG. 1, the buffer section 32*b* has a substantially rhombic section and can contain ink therein.

The air inlet tube 32 takes air into the ink reservoir 30 through the fresh-air communicating hole 32*a* while being able to contain ink therein. The buffer section 32*b* is formed for increasing the amount of ink to be contained larger than that of other parts of the air inlet tube 32.

The ink chamber 40, which is a substantially rectangular-prism ink tank, is connected to the ink reservoir 30 so that ink within the ink reservoir 30 can flow down therein. On the upper surface of the ink chamber 40, a cylindrical connection part 41 is provided. The inner diameter of the connection part 41 is set up larger than the outer diameter of the nozzle 31. Furthermore, at the upper end of the connection part 41, an O-ring 42 is attached. The inner diameter of the O-ring 42 and the outer diameter of the nozzle 31 are set up so that both elements can be fitted with each other. If the tip end of the nozzle 31 enters the connection part 41 via the O-ring 42, the nozzle 31 and the O-ring 42 are fitted with each other without clearance.

Also, a cylindrical ink-delivery part 43 is provided on the bottom surface of the ink chamber 40 so as to communicate with the ink chamber 40 for feeding the ink within the ink chamber 40 toward an ink ejection unit 100.

The valve 50 comprises an open region 51 between the ink reservoir 30 and the ink chamber 40 (communication region to the connection part 41 forming an upper portion of the ink chamber 40), a closing member 52 for opening and closing the open region 51, and a spring 53 for urging the closing member 52 in a direction closing the open region 51 (urging the closing member 52 in an upward direction in FIG. 1). The closing member 52 and the spring 53 are arranged within the ink chamber 40.

Although it is shown in FIG. 1 that the closing member 52 of the valve 50 is located at a position opening the open region 51 between the ink reservoir 30 and the ink chamber 40, in a steady state, the closing member 52 is urged into contact with the upper surface of the ink chamber 40 by an urging force of the spring 53 so as to close the open region 51.

The material of the closing member 52 may be any kind; however, it is preferable to be made of a rubber elastic body (elastomer) because of large closing ability. The spring 53 is a compression coil spring arranged so as to connect the bottom surface of the closing member 52 to the bottom surface of the ink chamber 40 for urging the closing member 52 upwardly.

According to the first embodiment, the ink reservoir 30 is to be an ink cartridge, which is detachably arranged in the printer head 1. As a detachable structure of the ink reservoir 30, there is a structure shown in FIG. 2, for example.

Figure 2:
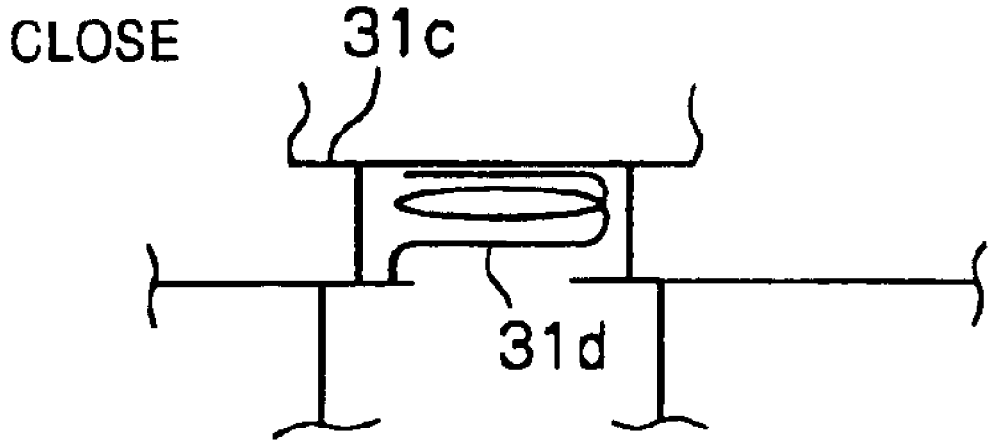
FIG. 2 is a drawing showing a detachable structure of an ink reservoir.
Figure 2:
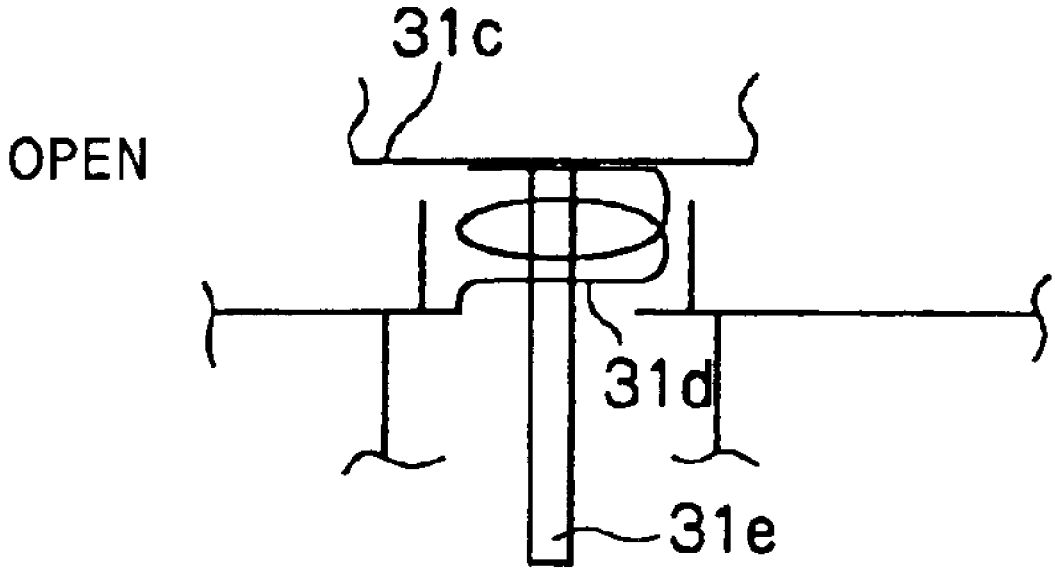

FIG. 2 is a drawing of an embodiment of a valve structure provided in the nozzle 31 showing both open and close states. First, in the close state shown in the upper side, by an urging force of a coil spring 31*d*, a valve 31*c* is closed. If the nozzle 31 of the ink reservoir 30 is mounted into the connection part 41, a stem 31*e* pushes up the valve 31*c* so that the nozzle 31 of the ink reservoir 30 is communicated with the connection part 41 of the ink chamber 40.

When the ink reservoir 30 is pulled up from the connection part 41, the valve 31*c* is closed by the operations reverse to the above. Therefore, just before the mounting the ink reservoir 30, even if the tip end of the nozzle 31 is faced downward, the ink inside cannot leak. Also, during replacement of the ink reservoir 30, if the ink reservoir 30 is drawn out, the valve 31*c* is immediately closed, so that the ink cannot leak from the tip end of the nozzle 31 also at this time.

Figure 3:
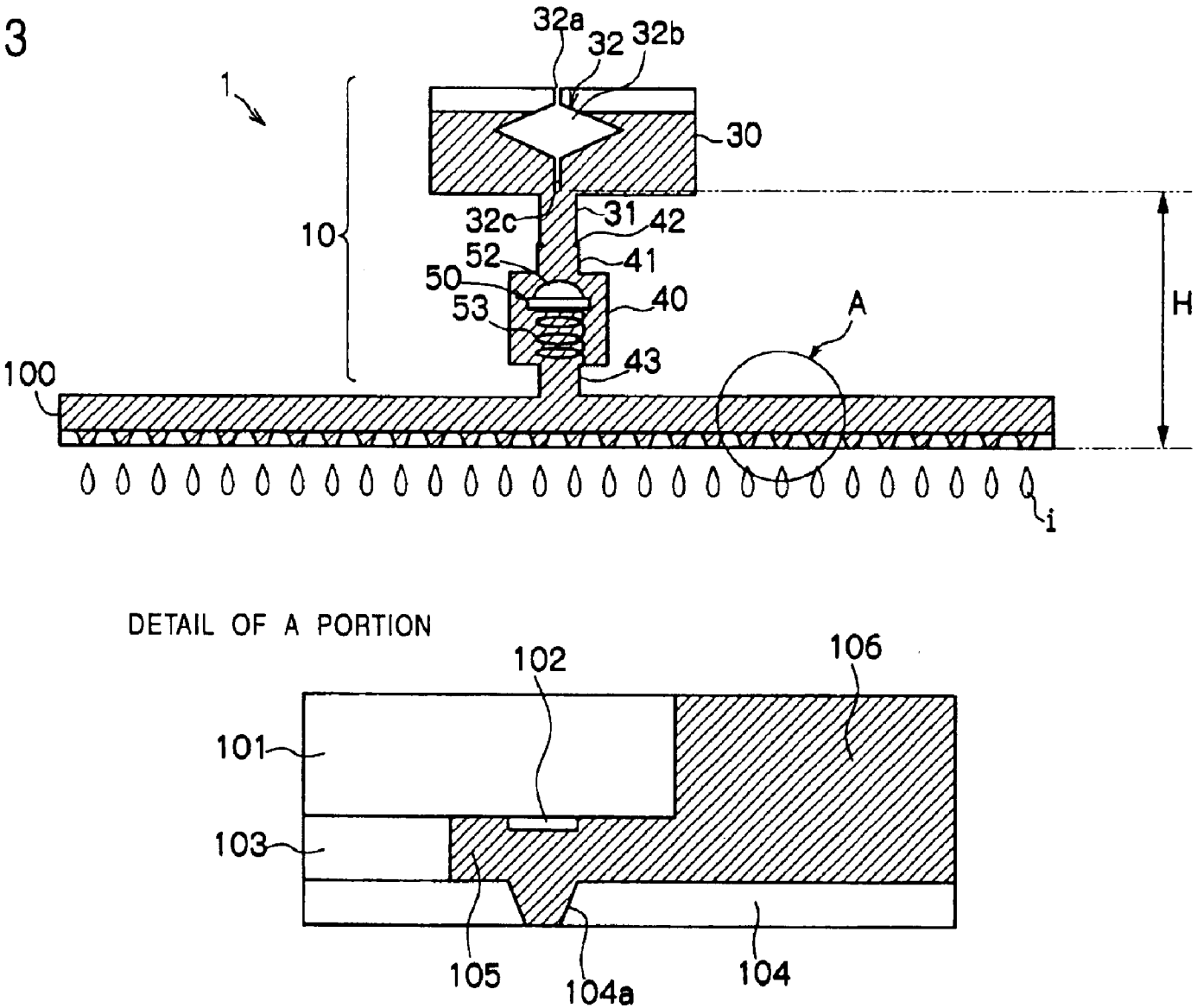
FIG. 3 includes a general drawing (front sectional view) of the printer head and a detailed drawing of A portion in the general drawing.

FIG. 3 includes a general drawing (front sectional view) of the printer head 1 and a detailed drawing of A portion.

The ink ejection unit 100 comprises a substrate 101, a film 103, and a nozzle sheet 104. The substrate 101 is made of a semiconductor substrate such as silicon and has heating resistors (heaters) 102 formed on one surface (bottom surface in FIG. 3) for heating ejecting ink.

The driving control of the heating resistor 102 is performed with the substrate 101, which is provided with a logic IC and a driver transistor (not shown).

The film 103 is laminated on the bottom surface of the substrate 101 in FIG. 3 and made of an exposure-curing type dry-film resist, for example. After the film 103 is laminated on substantially the entire surface of the substrate 101, on which the heating resistor 102 is formed, unnecessary parts are removed by a photolithography process so as to have a predetermined pattern.

Thereby, the film 103 is patterned so as to surround each heating resistor 102 in a substantially concave fashion. The part surrounding the heating resistor 102 is to be an ink-pressurizing chamber 105, so that the film 103 constitutes part of the ink-pressurizing chamber 105.

The nozzle sheet 104 is a sheet member having nozzles 104*a* built thereon for ejecting ink and laminated on the bottom surface of the film 103. The nozzle 104*a* is arranged to locate under each heating resistor 102 as a circular hole. The nozzle sheet 104 constitutes part of the ink-pressurizing chamber 105.

There are provided ink-passage parts 106 so as to communicate to each ink-pressurizing chamber 105. The ink-passage part 106 feeds ink supplied from the ink-feeding device 10 to each ink-pressurizing chamber 105. That is, the ink-passage part 106 is communicated with the ink-delivery part 43 mentioned above. Therefore, ink supplied from the ink-feeding device 10 flows into the ink-passage part 106 so that the ink-pressurizing chamber 105 is filled with the ink.

A number of the ink-pressurizing chambers 105 and the nozzles 104*a* are linearly juxtaposed on the substrate 101. As shown in the general drawing of FIG. 3, ink i is ejected from each nozzle 104*a*.

Continuously, ink supply after ink is ejected will be described in more detail.

FIGS. 4 to 7 are sectional views of the ink ejection unit 100 shown in the detailed drawing of FIG. 3, sequentially showing states of ink until the ink is supplied to the ink pressurizing chamber 105. Moreover, to the right of each ink ejection unit 100, the operation of the closing member 52 of the valve 50 in that state is shown in addition.

First, by a command from a printer control unit (not shown), an electric current pulse is passed through a selected heating resistor 102 for a small period of time (about 1 to 3 microsecond, for example), so that the heating resistor 102 is rapidly heated. As a result, a bubble (ink bubble) is produced in part of ink contacting the heating resistor 102, so that by the expansion of the bubble, some volume of ink is displaced. Thereby, the ink i contacting the nozzle 104*a* with the same volume as that of the displaced ink is ejected from the nozzle 104*a* as an ink droplet so as to land on a recording medium such as paper.

Figure 4:
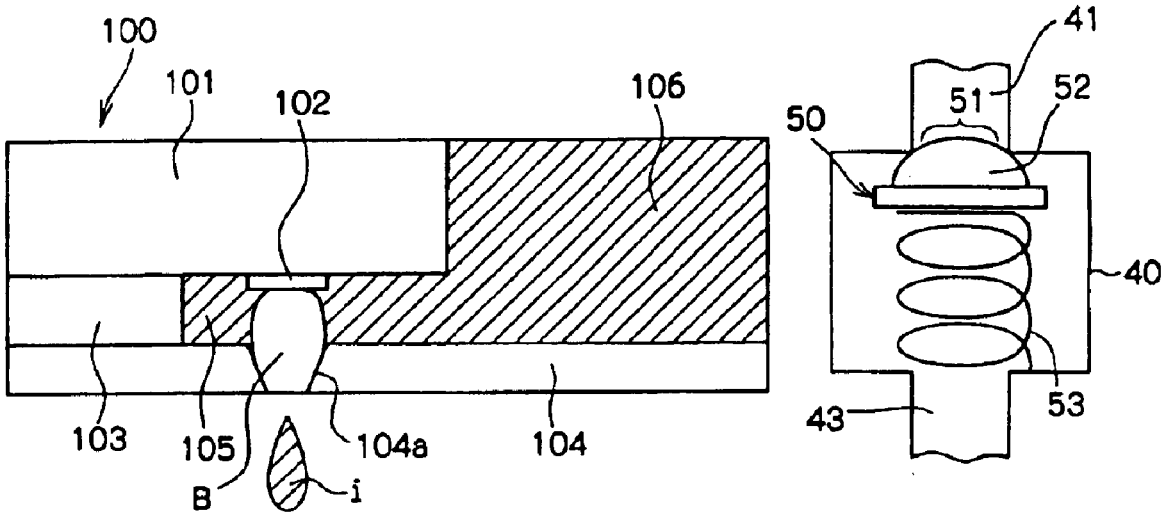
FIG. 4 is a sectional view of an ink ejection unit, showing a state of ink until being supplied to an ink-pressurizing chamber after it is ejected, as well as a state of a valve in the above state.

FIG. 4 shows an instant state that the ink i is ejected from the nozzle 104*a*. At this time, as shown in FIG. 4, the closing member 52 is pushed onto the top surface of the ink chamber 40 by an urging force of the spring 53, so that the closing member 52 is located at the position closing the open region 51.

Figure 5:
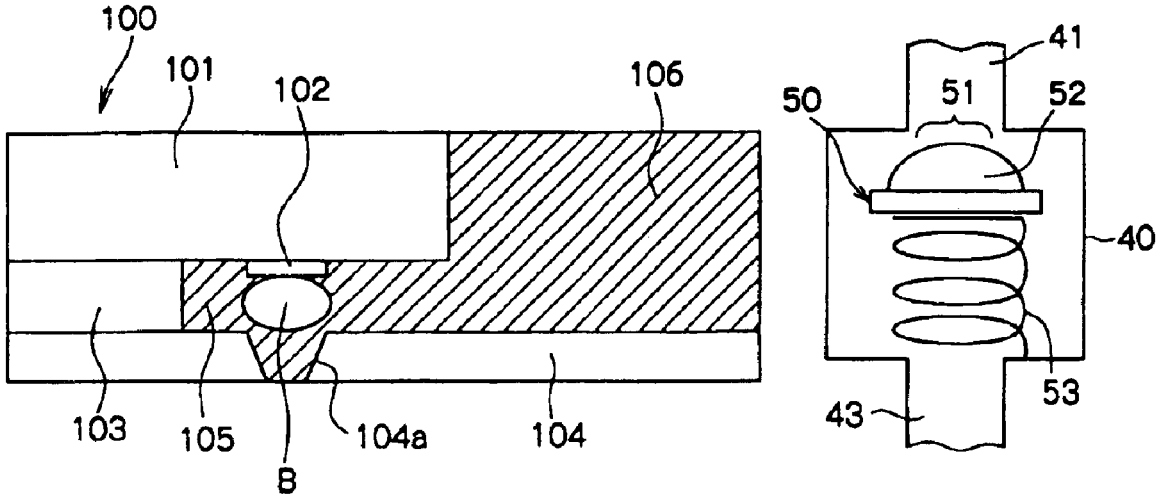
FIG. 5 is a drawing showing a state continued from FIG. 4.
Figure 6:
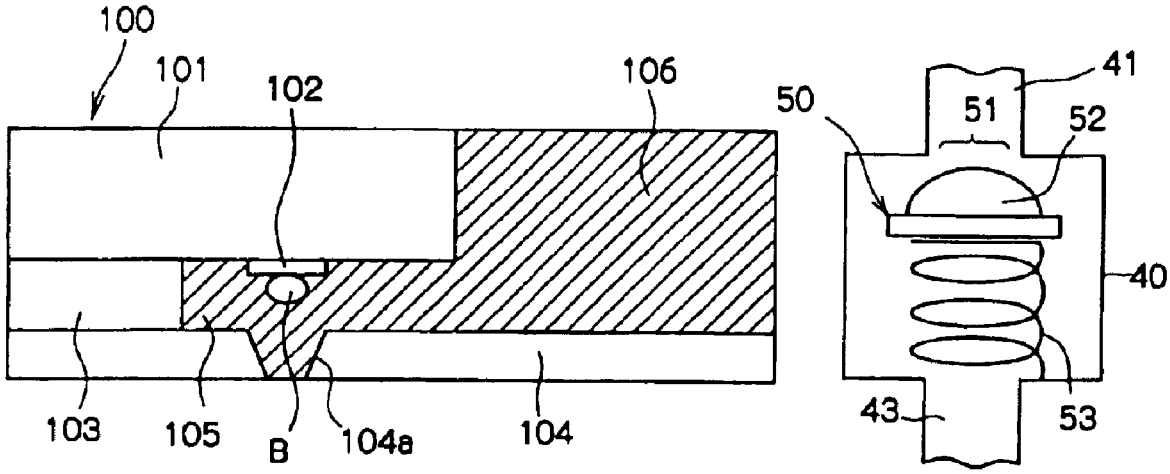
FIG. 6 is a drawing showing a state continued from FIG. 5.

Then, as shown in FIG. 5 and further in FIG. 6, the bubble B is gradually shrunk. Corresponding to the shrinkage, a force bringing ink in the ink-pressurizing chamber 105 is produced. By the production of the bringing force, ink is supplied into the ink-pressurizing chamber 105 wherein the ink-pressurizing chamber 105, the ink-passage part 106, and the ink-delivery part 43 of the ink chamber 40 are communicated with each other. Therefore, the communicated parts from the ink-pressurizing chamber 105 to the ink chamber 40 is reduced in pressure smaller than ever. As a result, in the ink chamber 40, a sucking force is produced for sucking ink, so that a force is applied to the closing member 52 so as to move it downward against the urging force of the spring 53. Thereby, the open region 51 forming the upper portion of the ink chamber 40 is opened, so that ink is fed from the ink reservoir 30 toward the ink chamber 40.

If ink in the ink reservoir 30 flows down to the ink chamber 40, the amount of ink in the ink reservoir 30 is reduced so that the pressure of the ink reservoir 30 decreases. Thereby, air (fresh air) enters the ink reservoir 30 through the lower end 32*c* of the air inlet tube 32. This air becomes bubbles so as to float through ink, and is finally stored in an upper portion forming the ink reservoir 30 (as well as outside the air inlet tube 32). In such a manner, if ink in the ink reservoir 30 flows down to the ink chamber 40, air enters the ink reservoir 30 by the amount corresponding to the amount of ink reduced by the flowing down from the fresh-air communicating hole 32*a* via the air inlet tube 32.

Figure 7:
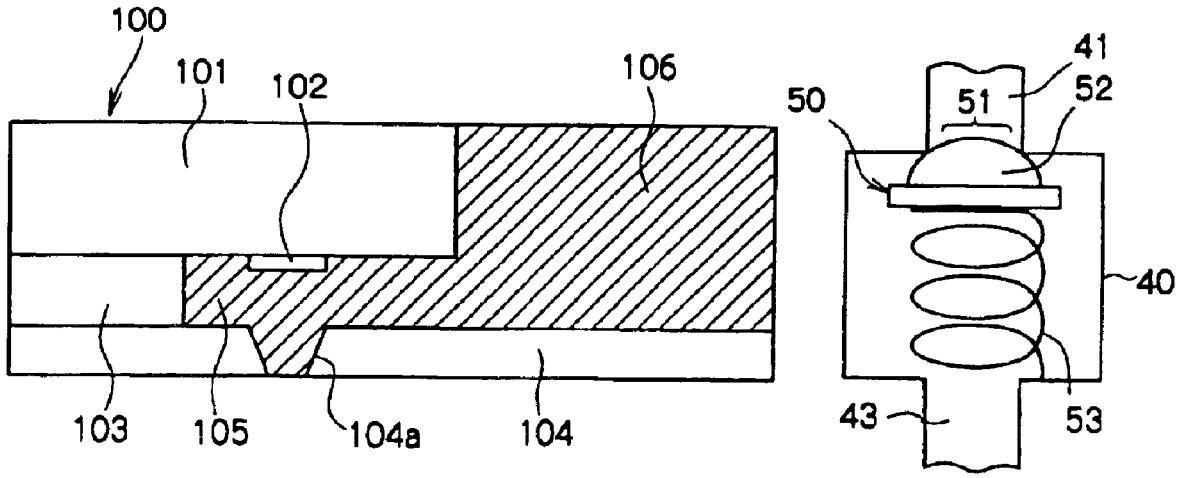
FIG. 7 is a drawing showing a state continued from FIG. 6.

Then, as shown in FIG. 7, if the bubble B in the ink-pressurizing chamber 105 vanishes, the pressure in the communicated parts from the ink-pressurizing chamber 105 to the ink chamber 40 is restored to ever, so that the absorbing force for bringing ink vanishes in the ink chamber 40. Therefore, the spring 53 pushes up the closing member 52 into contact with the top surface of the ink chamber 40 by the urging force thereof so as to close the open region 51 again. Thereby, the flowing down of ink from the ink reservoir 30 to the ink chamber 40 is stopped, and the state before ink is ejected from the nozzle 104*a* is restored to be under an equilibrium condition.

In such a manner, when ink is ejected from the ink ejection unit 100 to use the ink, the closing member 52 is opened and the operation described above is repeated. Thereby, ink in the ink reservoir 30 gradually decreases.

Also, as shown in FIG. 1, because the air inlet tube 32 having the fresh-air communicating hole 32*a* is provided inside the ink reservoir 30 while the lower end 32*c* of the air inlet tube 32 is located at a position lower than the top surface of the ink reservoir 30, even when vibrations are applied to the ink reservoir 30 or the ink reservoir 30 is inclined, ink in the ink reservoir 30 can be prevented from leaking outside.

Furthermore, for changes in pressure or temperature, ink in the ink reservoir 30 can also be prevented from leaking.

Figure 8:
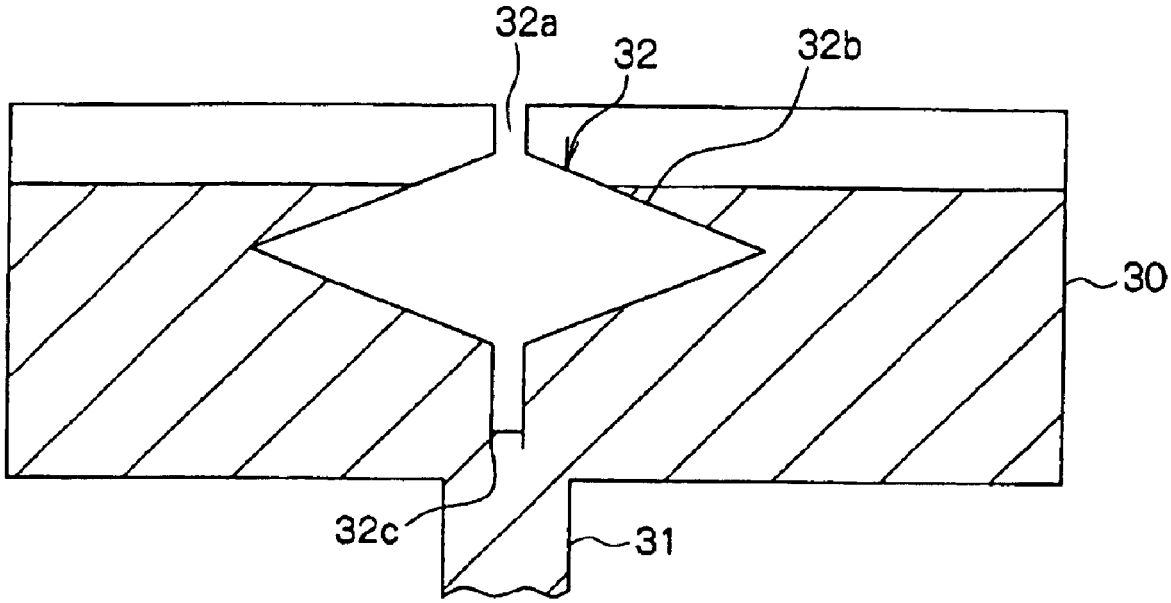
FIG. 8 is a drawing showing a state of ink in an ink reservoir under the normal temperature and pressure condition.
Figure 9:
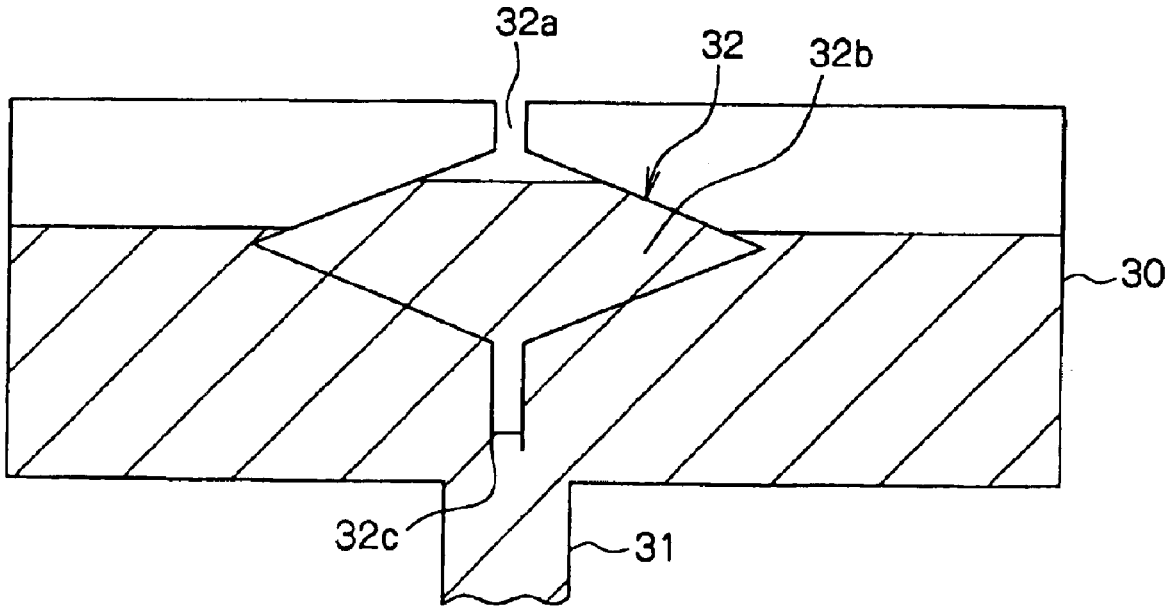
FIG. 9 is a drawing showing a state of ink in the ink reservoir under a high temperature and a low pressure condition.

FIGS. 8 and 9 are drawings illustrating this advantage; FIG. 8 shows the state of normal temperature and pressure, in which there is scarcely ink in the air inlet tube 32.

If decrease in pressure or increase in temperature occurs from this state, air in the ink reservoir 30 existing outside the air inlet tube 32 (air existing in an upper portion forming the ink reservoir 30 and shielded from fresh air) is expanded. By the expansion of the air, as shown in FIG. 9, the level of the ink existing outside the air inlet tube 32 is lowered. Although the ink flows back toward the air inlet tube 32 by that amount, this ink is temporarily stored in the buffer section 32*b* of the air inlet tube 32 so as to prevent the ink in the ink reservoir 30 from leaking outside.

When the ink reservoir 30 is not in use of ink the air inlet tube 32 may or may not be filled with ink. If the ink reservoir 30 is attached to the ink-feeding device 10 in a state that no ink exists in the air inlet tube 32, it becomes the state shown in FIG. 1 at the beginning.

Whereas in the state that substantially the entire ink reservoir 30 including the air inlet tube 32 is filled with ink, if the ink reservoir 30 is attached to the ink-feeding device 10, only the ink in the air inlet tube 32 is used at the beginning. This is because only the inside of the air inlet tube 32 is communicated with the atmosphere via the fresh-air communicating hole 32*a*. Then, when substantially the entire ink in the air inlet tube 32 is consumed, the state shown in FIG. 1 is restored.

Wherein in the state that substantially the entire ink reservoir 30 including the air inlet tube 32 is filled with ink, enclosed air in the ink reservoir 30 existing outside the air inlet tube 32 (air layer) is very small in volume. Therefore, although the expansion of the enclosed air is produce by the decrease in pressure or increase in temperature, the reduction in the level of the ink existing outside the air inlet tube 32 is also very small, so that the amount of the back-flow due to the decrease in pressure or increase in temperature is extremely reduced. Thereby, ink cannot leak out of the fresh-air communicating hole 32*a*.

As described above, when the ink reservoir 30 is not in use of ink, the air inlet tube 32 may or may not be filled with ink. In any state, the outside leakage of ink in the ink reservoir 30 due to the decrease in pressure or increase in temperature can be prevented.

Next, according to the embodiment, the meniscus holding power of ink at the lower end 32*c* of the air inlet tube 32 will be described.

Figure 10:
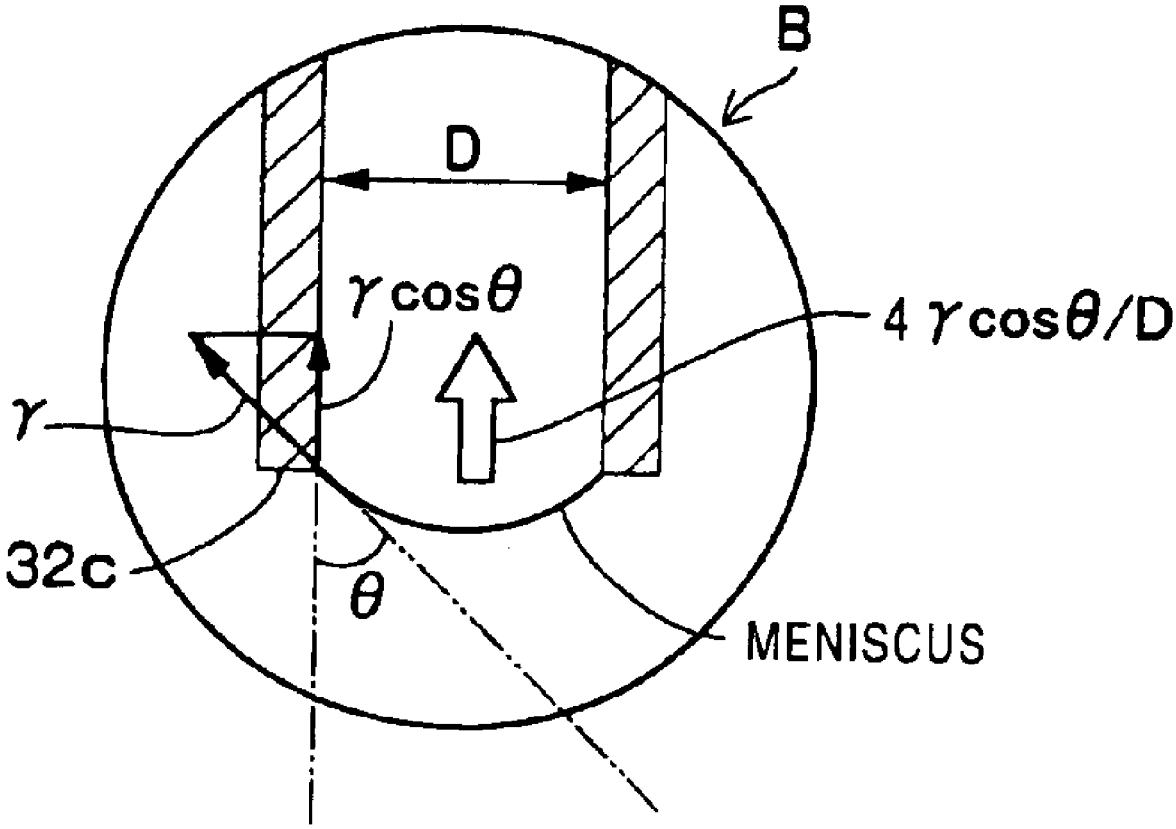
FIG. 10 is a detailed drawing of B portion of FIG. 1 illustrating the lower end of an air inlet tube and a meniscus of ink.

FIG. 10 is a detailed drawing of B portion of FIG. 1 illustrating a meniscus of ink at the lower end 32*c* of the air inlet tube 32. As shown in FIG. 10, the meniscus being downward convex is formed at the lower end 32*c* of the air inlet tube 32.

Referring to FIG. 10, the surface tension of ink is indicated by $\gamma$; the bore diameter of the lower end 32*c* of the air inlet tube 32 is denoted by D; and the contact angle between ink and the lower end 32*c* of the air inlet tube 32 is represented by $\theta$.

Wherein the component in the vertical direction of the surface tension $\gamma$ is expressed as follows:

$$\gamma \cos \theta.$$

Since the component in the vertical direction of the surface tension $\gamma$ is applied to the circumference ($\pi D$) of the lower end 32*c* of the air inlet tube 32, the component in the vertical direction of the surface tension $\gamma$ over the entire circumference becomes:

$$\pi D \gamma \cos \theta.$$

If the above value is divided by the opening space ($S=\pi D^2/4$) of the lower end 32*c* of the air inlet tube 32, a force for holding the meniscus formed at the lower end 32*c* of the air inlet tube 32 (meniscus power (pressure)) can be obtained. If this power is indicated by P:

$$\text{The meniscus power } P=\pi D\gamma \cos \theta/(\pi D^2/4)=4\gamma \cos \theta/D.$$

On the other hand, the pressure inside the ink-feeding device 10 and the ink ejection unit 100 is maintained lower than the atmospheric pressure. This is because if the pressure in the ink ejection unit 100 were larger than the atmospheric pressure, the ink would leak out of the nozzle 104*a*. Therefore, the pressure in the ink ejection unit 100 is necessary to be maintained lower than the atmospheric pressure. This pressure acts as a force moving the meniscus of ink downward in FIG. 10.

Whereas the meniscus holding power P described above is a force for holding the ink meniscus, which is the force in the upward direction in FIG. 10. If the meniscus holding power P at the lower end 32*c* of the air inlet tube 32 is larger than the pressure inside the ink reservoir 30, the ink meniscus is maintained.

However, if ink is used so that ink flows out of the ink reservoir 30 to the ink chamber 40, the pressure in the ink reservoir 30 is reduced further than ever, so that the force moving the meniscus of ink downward is further increased.

By this force, if the ink meniscus is moved in the downward direction in FIG. 10, it cannot be maintained at the lower end 32*c* of the air inlet tube 32 and is destroyed. Thereby, from the lower end 32*c* of the air inlet tube 32, air is entered into the ink reservoir 30.

Then, when the air is entered into the ink reservoir 30, so that the pressure in the ink reservoir 30 is increased, the pressure in the ink reservoir 30 is returned to the pressure hereinbefore. The ink meniscus is thereby formed again at the lower end 32*c* of the air inlet tube 32 and is maintained by the meniscus power.

As described above, wherein if ink is ejected from the ink ejection unit 100 and used, it is established to further reduce the inside pressure so as to open the valve 50.

However, as it is necessary that the valve 50 be established to open and close by subtle changes in the inside pressure, the spring 53 having a small elastic constant is used. Accordingly, there may be problems that the closing operation of the valve 50 is not precisely performed by the mixing of foreign particles, or the elastic constant may change per hour by the metal fatigue of the spring 53. Thereby, the closing operation of the valve 50 may not be precisely performed. In this case, the inside pressure cannot be maintained to be a predetermined pressure lower than the atmospheric pressure.

If the closing operation of the valve 50 is not precisely performed, the pressure in the ink-feeding device 10 and the ink ejection unit 100 cannot be maintained to be a pressure capable of holding ink therein, so that ink leaks out of the nozzle 104*a*.

Then, according to the embodiment, even if the closing operation of the valve 50 is not precisely performed, the pressure in the ink-feeding device 10 and the ink ejection unit 100 is established to be able to maintain a pressure capable of holding ink therein.

While the atmospheric pressure is applied to the nozzle 104*a*, to the lower end 32*c* of the air inlet tube 32, the water head H (see FIG. 1 and it is smaller than the atmospheric pressure) is applied corresponding to the height from the bottom surface of the nozzle 104*a* to the lower end 32*c* of the air inlet tube 32.

If the absolute value of the meniscus holding power P of ink at the lower end 32*c* of the air inlet tube 32 is larger than the absolute value of the water head pressure H, even when the valve 50 is being opened, air is not entered from the air inlet tube 32, so that ink cannot leak out of the nozzle 104*a*.

That is, if:

$$P=4\pi\gamma \cos \theta/D>H,$$

air is not entered from the air inlet tube 32, so that ink cannot leak out of the nozzle 104*a*.

If the equation above is modified, $$D<4\pi\gamma \cos \theta/H.$$

Based on this equation, if values of the bore diameter D of the lower end 32*c* of the air inlet tube 32 and the water head pressure are determined, ink can be prevented from leaking out of the nozzle 104*a*.

The case described above is where the aperture shape of the lower end 32*c* of the air inlet tube 32 is circular.

Figure 11:
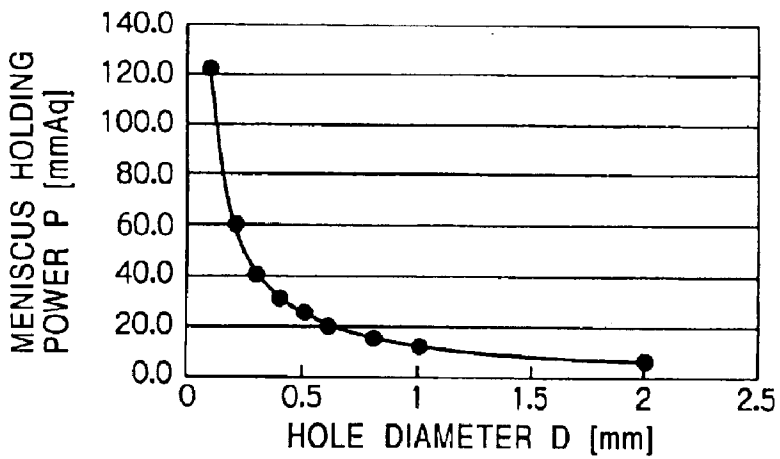
FIG. 11 includes data of the surface tension of ink, the bore diameter of the lower end of the air inlet tube, the circumference of the lower end of the air inlet tube, the opening space of the lower end of the air inlet tube, the contact angle, and the meniscus holding power; and a graph of the relationship between the bore diameter and the meniscus holding power.

FIG. 11 includes data of the surface tension $\gamma$ of ink, the bore diameter D of the lower end 32*c* of the air inlet tube 32, the circumference L ($\pi$D) of the lower end 32*c* of the air inlet tube 32, the opening space S ($=\pi D^2/4$) of the lower end 32*c* of the air inlet tube 32, the contact angle $\theta$, and the meniscus holding power P; and a graph of the relationship between the bore diameter D and the meniscus holding power P.

Referring to FIG. 11, if the water head pressure H is 20 mmAq, ink cannot leak out of the nozzle 104*a* when the bore diameter D is about 0.6 mm or less.

Also, when the bore diameter D is 0.3 mm, for example, the meniscus holding power P is about 40.6 mmAq, so that ink cannot leak out of the nozzle 104*a* if the water head pressure H is less than 40.6 mmAq.

In addition, for the design in practice, in view of the inclination of the ink ejection unit 100 and manufacturing errors such as work tolerances, it is preferable that the water head be small (H=about 20 mmAq, for example), leaving some surpluses.

(Second Embodiment)

Figure 12:
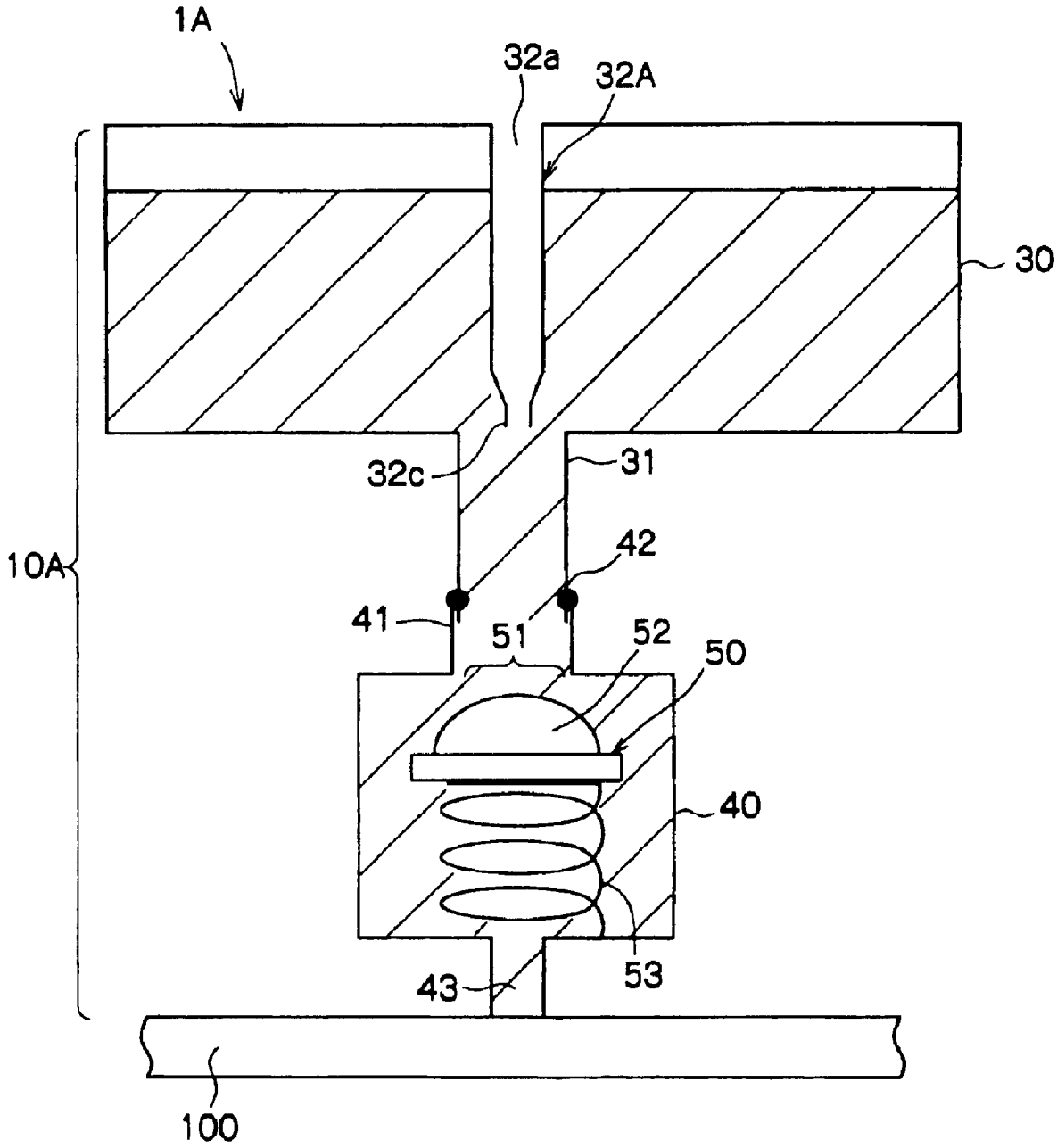
FIG. 12 is a front sectional view of a printer head according to a second embodiment of the present invention.
Figure 13:
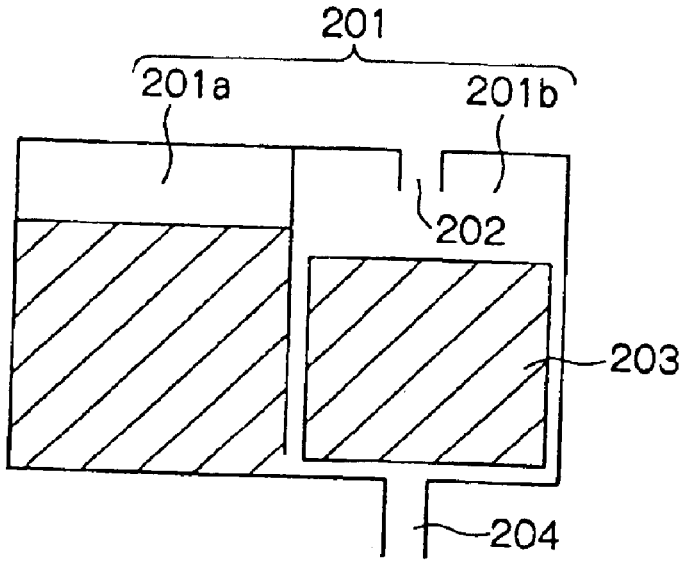
PRIOR ART FIG. 13
FIG. 13 is a drawing a first example of a conventional ink-feeding device.
Figure 14:
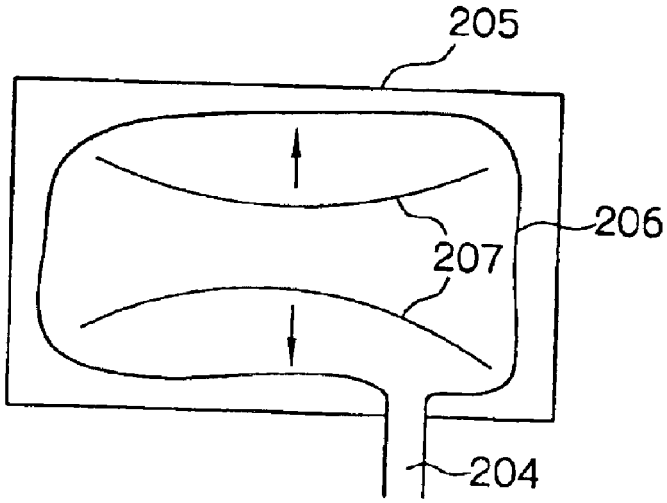
PRIOR ART FIG. 14
FIG. 14 is a drawing a second example of the conventional ink-feeding device.

FIG. 12 is a front sectional view of a printer head 1A according to a second embodiment of the present invention. According to the second embodiment, an ink-feeding device 10A different from that of the first embodiment is provided.

The ink-feeding device 10A has an air inlet tube 32A different from that of the first embodiment, and other elements are the same as those of the first embodiment.

The air inlet tube 32A has not a buffer section differently from the air inlet tube 32 according to the first embodiment. The air inlet tube 32A is structured to be cylindrical and has a constant cross-section along the longitudinal direction except for the vicinity of the lower end 32*c*. The space of the cross-section of the air inlet tube 32A is larger than that of the air inlet tube 32 according to the first embodiment except for the buffer section 32*b*.

In such a manner, the air inlet tube 32A has not the buffer section 32*b* according to the second embodiment; as long as ink can be stored in the inside during the back flowing of ink, it is not necessarily to have the buffer section 32*b*.

The bore diameter D of the lower end 32*c* according to the second embodiment is the same as that according to the first embodiment. That is, as long as the bore diameter D of the lower end 32*c* has a predetermined size, the meniscus of ink can be held at the lower end 32*c*, so that other parts of the air inlet tube 32A may have any shape.

In addition, the cross-section of the air inlet tube 32A may be circular or any shape other than the circle such as a polygon.

Even when the air inlet tube 32A is structured in such a manner, the same advantages as those of the first embodiment can be obtained.

The embodiments according to the present invention have been described as above; the present invention is not limited to the embodiments described above, and various modifications may be made as follows, for example.

1) According to the embodiments, as the ink ejection unit 100, a thermal system is exemplified, in which ink is heated for ejecting in the ink-pressurizing chamber 105 by the heating resistor 102; however, not limiting to this, an electrostatic ejection system or a piezoelectric system may be incorporated.

In the electrostatic ejection system, there are provided a diaphragm and two electrodes arranged under the diaphragm with an air layer therebetween, as energy generating means. By applying a voltage between both the electrodes, the diaphragm is deflected downward, then, the voltage is adjusted to be 0 V so as to open an electrostatic force At this time, by utilizing an elastic force when the diaphragm returns to the original state, ink is ejected.

The piezoelectric system employs a layered product of a piezoelectric element having electrodes formed on both surfaces and a diaphragm, as energy generating means. If a voltage is applied across the electrodes on both surfaces of the piezoelectric element, a bending moment is produced on the diaphragm with a piezoelectric effect so as to deflect the diaphragm. Ink is ejected by this deflection.

2) According to the embodiments, the ink reservoir 30 is constructed detachably; alternatively, the nozzle 31 of the ink reservoir 30 and the connection part 41 of the ink chamber 40 may be integrally connected together. In this case, the O-ring 42 is not provided. In this structure, using the ink reservoir 30 not as an ink cartridge, as in the first and second embodiments, when ink in the ink reservoir 30 is consumed, the entire ink-feeding device 10 or 10A may be replaced (in this case, it is necessary to construct the ink-feeding device 10 or 10A detachably to the ink ejection unit 100), or the entire printer head 1 or 1A including the ink ejection unit 100 may be replaced.

3) According to the embodiments, the printer head 1 or 1A and the ink-feeding device 10 or 10A are exemplified; however, in addition to ink, various liquid-feeding devices and liquid ejection devices may be incorporated. For example, a device for ejecting a solution containing DNA for detecting a biological material may be incorporated.

According to the liquid-feeding device of the present invention, since a porous material for holding liquid therein is not provided in the liquid reservoir, the liquid capacity can be increased. Also, without using a spring for reducing the pressure in the liquid reservoir, the gas-liquid interchange is performed between the liquid reservoir and the liquid chamber while opening and closing are performed by the closing member of the valve between the liquid reservoir and the liquid chamber, so that the structure can be simplified, and the liquid can be stably held without leakage.

Since the air inlet tube is arranged to extend from the fresh-air communicating hole toward the inside of the liquid reservoir, as long as the entire air inlet tube is not filled with liquid, even when vibrations are applied to the liquid-feeding device or it is inclined, liquid can be prevented from leaking via the fresh-air communicating hole.

Furthermore, in the case where the air inlet tube has the buffer section, even if air in the liquid reservoir is expanded when decrease in pressure or increase in temperature occurs so that liquid back flows toward the fresh-air communicating hole, the liquid can be contained in the air inlet tube, preventing liquid from leaking via the fresh-air communicating hole. Moreover, in the case where the liquid reservoir except the air inlet tube is filled with liquid, even if enclosed air is expanded by decrease in pressure or increase in temperature, liquid back flows toward the air inlet tube and the liquid can be contained in the air inlet tube, preventing liquid from leaking via the fresh-air communicating hole.

Furthermore, in the case where the liquid reservoir including the air inlet tube is filled with liquid, even if enclosed air is expanded by decrease in pressure or increase in temperature, an amount of the liquid back flowing toward the air inlet tube is small, preventing liquid from leaking via the fresh-air communicating hole.

What is claimed is:

1. A liquid-feeding device comprising:

a liquid reservoir for containing liquid therein;

a liquid chamber connected to the liquid reservoir so that liquid in the liquid reservoir can flow down;

a valve comprising an open region between the liquid reservoir and the liquid chamber and a closing member urged so as to close the open region so that the closing member is displaced so as to open the open region by the reduction in pressure of the liquid chamber due to the reduction in the amount of liquid in the liquid chamber;

a fresh-air communicating hole built in the liquid reservoir for communicating with fresh air; and an air inlet tube arranged to extend from the fresh-air communicating hole toward the inside of the liquid reservoir so that when an amount of liquid in the liquid chamber is reduced, the amount of air corresponding to the amount of the reduced liquid can be brought into the liquid reservoir from the fresh-air communicating hole, wherein a bore diameter of a lower end of the air inlet tube and a water head pressure H are determined so that the meniscus holding power P of liquid at a lower end of the air inlet tube and the water head pressure H corresponding to a height from a liquid outlet, to which atmospheric pressure is applied satisfy the relationship:

$$P>H.$$

2. A device according to claim 1, wherein the air inlet tube is provided with a buffer section formed in part of the air inlet tube so as to have a liquid-containing capacity larger than that of other parts of the air inlet tube.

3. A device according to claim 1, wherein the air inlet tube is provided with a buffer section formed in part of the air inlet tube so as to have a liquid-containing capacity larger than that of other parts of the air inlet tube, and wherein the liquid reservoir including the air inlet tube is filled with liquid in advance.

4. A device according to claim 1, wherein the air inlet tube is provided with a buffer section formed in part of the air inlet tube so as to have a liquid-containing capacity larger than that of other parts of the air inlet tube, and wherein the liquid reservoir except the air inlet tube is filled with liquid in advance.

5. A liquid-ejection device comprising:

a liquid-feeding device which comprises a liquid reservoir for containing liquid therein; a liquid chamber connected to the liquid reservoir so that liquid in the liquid reservoir can flow down; a valve comprising an open region between the liquid reservoir and the liquid chamber and a closing member urged so as to close the open region so that the closing member is displaced so as to open the open region by the reduction in pressure of the liquid chamber due to the reduction in the amount of liquid in the liquid chamber; a fresh-air communicating hole built in the liquid reservoir for communicating with fresh air; and an air inlet tube arranged to extend from the fresh-air communicating hole toward the inside of the liquid reservoir so that when an amount of liquid in the liquid chamber is reduced, the amount of air corresponding to the amount of the reduced liquid can be brought into the liquid reservoir from the fresh-air communicating hole; and a liquid ejection unit communicated with the liquid-feeding device and having nozzles for ejecting liquid supplied from the liquid-feeding device, wherein a bore diameter of the lower end of the air inlet tube and a water head are determined so that the meniscus holding power P of liquid at the lower end of the air inlet tube and the water head pressure H corresponding to the height from the surface of the nozzles of the liquid ejection unit to the lower end of the air inlet tube satisfy the relationship:

$$P>H.$$

6. A device according to claim 5, wherein the air inlet tube is provided with a buffer section formed in part of the air inlet tube so as to have a liquid-containing capacity larger than that of other parts of the air inlet tube.

7. A device according to claim 5, wherein the air inlet tube is provided with a buffer section formed in part of the air inlet tube so as to have a liquid-containing capacity larger than that of other parts of the air inlet tube, and wherein the liquid reservoir including the air inlet tube is filled with liquid in advance.

8. A device according to claim 5, wherein the air inlet tube is provided with a buffer section formed in part of the air inlet tube so as to have a liquid-containing capacity larger than that of other parts of the air inlet tube, and wherein the liquid reservoir except the air inlet tube is filled with liquid in advance.

* * * * *